United States Patent [19]

Paradis

[11] Patent Number: 4,506,651

[45] Date of Patent: Mar. 26, 1985

[54] WOOD STOVE

[76] Inventor: Prudent R. Paradis, 307 Queen Mary St., Ottawa, Ontario, Canada, K1K 1W8

[21] Appl. No.: 531,073

[22] Filed: Sep. 12, 1983

[30] Foreign Application Priority Data

Sep. 21, 1982 [CA] Canada ..... 411854

[51] Int. Cl.[3] ..... F24C 1/14

[52] U.S. Cl. ..... 126/4; 126/19 R; 126/1 F

[58] Field of Search ..... 126/4, 1 AB, 1 AC, 1 AD, 126/1 F, 1 D, 1 AE, 19 R, 21 R, 273 R, 6, 1 AA, 60, 61, 70, 77, 307 R

[56] References Cited

U.S. PATENT DOCUMENTS

| | | | |
|---|---|---|---|
| 44,348 | 9/1864 | Simpson | 126/4 |
| 472,533 | 4/1892 | Frost | 126/1 AE |
| 697,091 | 4/1902 | Kistler | 126/4 |
| 812,381 | 2/1906 | Tatum | 126/4 |
| 977,408 | 11/1910 | Kingsland | 126/1 D |
| 1,189,818 | 7/1916 | Holloway | 126/1 D |
| 1,417,404 | 5/1922 | Mustonen | 126/4 |
| 2,144,291 | 1/1939 | Henderson | 126/4 |
| 2,480,610 | 8/1949 | Reynolds | 126/4 |
| 2,627,265 | 2/1953 | Tate | 126/19 R |
| 4,182,302 | 1/1980 | Bruce | 126/4 |
| 4,368,721 | 1/1983 | Kroupa | 126/4 |

FOREIGN PATENT DOCUMENTS

| | | |
|---|---|---|
| 54671 | 1/1896 | Canada . |
| 60149 | 5/1898 | Canada . |

*Primary Examiner*—Samuel Scott
*Assistant Examiner*—Noah Kamen

[57] ABSTRACT

The specification describes a combination wood burning stove and oven comprising a housing having a combustion chamber, a heat transfer chamber and an oven disposed in the heat transfer chamber, a combustion product intake opening means communicating the combustion chamber and heat transfer chamber, a combustion product outlet opening in the heat transfer chamber for connection with an exterior flue pipe and an interior flue pipe means disposed in the heat transfer chamber adjacent the oven and interconnecting the intake opening means and outlet opening, the interior flue pipe means serving as a heat exchanger for the transfer of heat therefrom to the oven.

9 Claims, 3 Drawing Figures

WOOD STOVE

The present invention relates to a combination heating and cooking stove.

The present invention seeks to provide an efficient and economical wood burning stove formed with an oven which is surrounded by a heat transfer chamber in which a portion of the stove flue pipe is disposed for transferring heat to the heat transfer chamber and the oven.

Generally, the present invention is defined as a wood burning stove comprising a housing having a combination chamber, a heat transfer chamber and an oven disposed in the heat transfer chamber. A combustion product intake opening means communicates the combustion chamber and the heat transfer chamber while a combustion product outlet opening is disposed in the heat transfer chamber for connection to an exterior flue pipe. An interior flue pipe means is disposed in the heat transfer chamber adjacent the oven and interconnects the combustion product intake opening means and the outlet means. The interior flue pipe means serves as a heat transfer means whereby when products of combustion flow through the interior flue pipe means, the air within the transfer chamber is heated which air in turn heats the walls of the oven.

These and other features of the invention will become more apparent from the following description in which reference is made to the appended drawings wherein.

Figure 1:
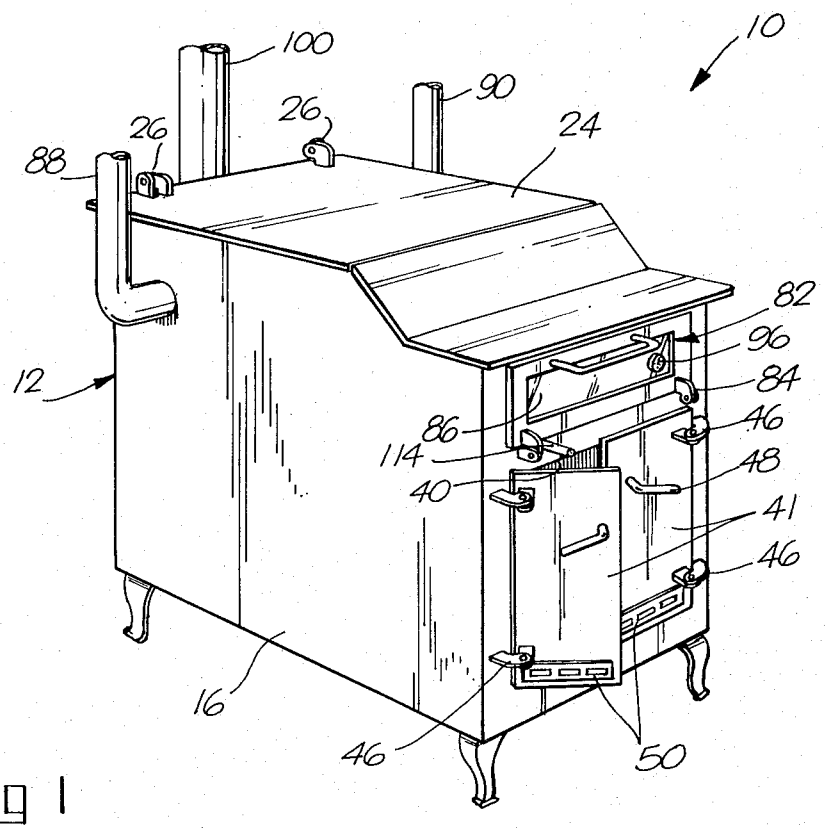
FIG. 1 is a perspective view of the combination wood burning stove and oven of the present invention.

The combination oven and wood burning stove of the present invention is generally designated by reference numeral 10. The stove has a housing 12 having a bottom wall or floor 14, spaced side walls 16 and 18, a rear wall 20, a front wall 22 and a top wall 24. The bottom, side, rear and front walls are interconnected together such as by welding and made of steel plate or the like in a manner well known to those skilled in the art. Top wall 24 is pivotally connected to rear wall 12 of the housing as by hinges 26 for reasons which will be explained later.

The housing is sub-divided into a lower chamber 28 and an upper chamber 30 by a horizontally disposed steel plate 32 secured to the front, side and rear walls of the housing as by welding. The lower chamber 28 defines a combustion chamber while the upper chamber 30 is further sub-divided into a heat transfer or exchange section 34 and an oven section 36.

Lower chamber 28 defines the fire box or combustion chamber and has an opening 40 formed in front wall 22 of the housing. Door means 42 serve to open and sealingly close the opening 40. Door means 42 may be of any desired type. In the illustrated embodiment of the invention, door means 42 is comprised of a pair of doors 44 hinged to front wall 22 of the housing by hinges 46 for pivotal movement about vertical axes. Doors 44 are provided with suitable latches 48. Doors 44 are also provided with adjustable air inlet means 50 of any suitable type for controlling the flow of air into the combustion chamber.

Figure 3:
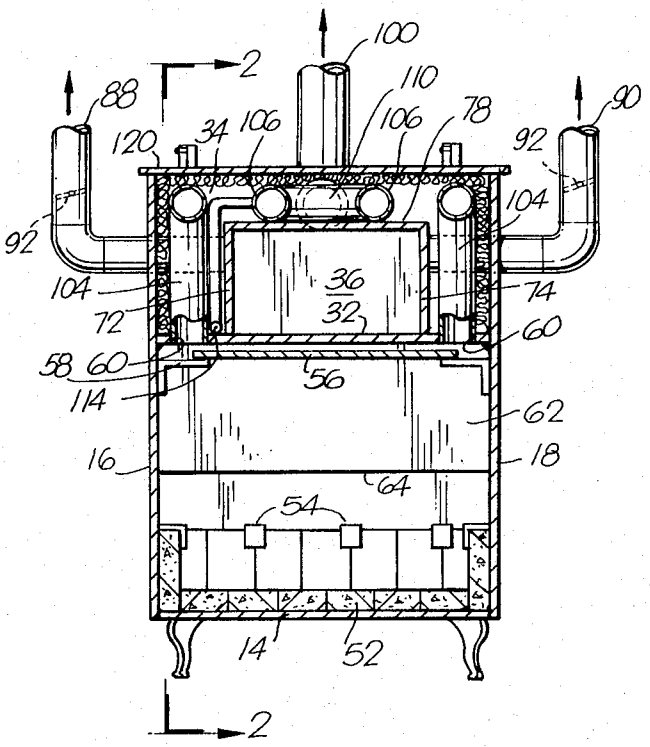
FIG. 3 is a transverse cross-sectional view taken along lines 3—3 of FIG. 2.
Figure 2:
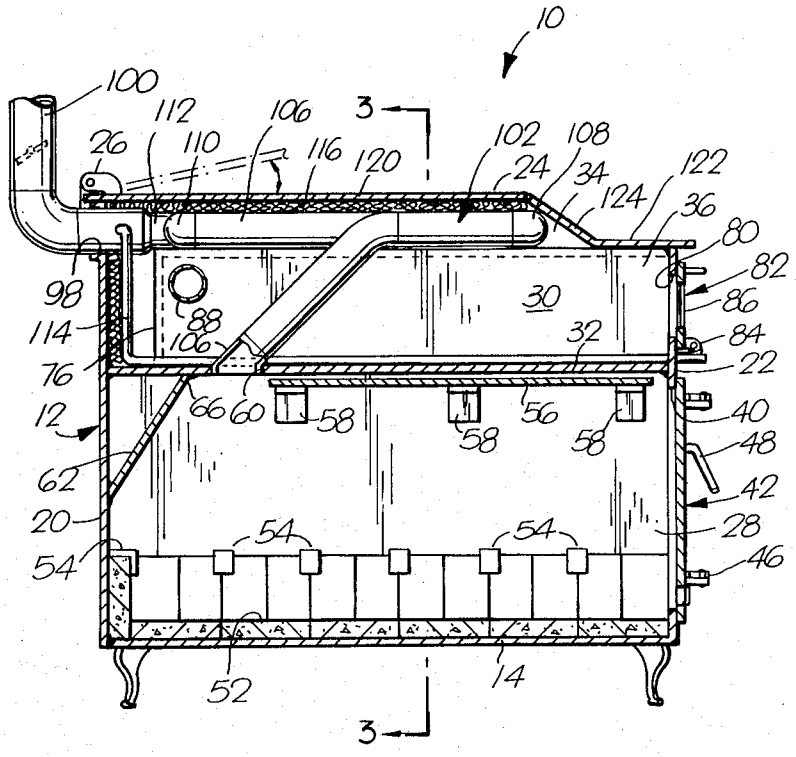
FIG. 2 is a longitudinal cross-sectional view taken along lines 2—2 of FIG. 3.

With reference to FIGS. 2 and 3, bottom wall 14, side walls 16 and 18 and rear wall 20 of the housing are lined with fire brick 52 in the usual fashion. Angle bracket members 54 are provided for supporting fire brick 52 as shown. A removable steel plate 56 is supported just below the underside of horizontal plate 32 by angle members 58 secured as by welding to the interior surfaces of opposed side walls 16 and 18 of the housing. Removable plate 56 serves to prevent direct contact of the flame within the combustion chamber with the horizontal steel plate 32 so as to extend the life of such plate.

A pair of transversely spaced combustion product flue openings 60 are formed in partition plate 32 adjacent the rearward end thereof while a deflector plate 62 is provided for directing products of combustion toward flue openings 60. As best shown in FIGS. 2 and 3, deflector plate 62 extends transversely of the housing between side walls 16 and 18, has a lower marginal edge 64 abutting rear wall 20 and an upper marginal edge 66 abutting the underside of horizontal plate 32. Deflector plate 62 may be secured to the housing in any suitable fashion such as by welding.

The oven section 36 is formed by a pair of side walls 72 and 74 sealingly connected to and extending vertically from a horizontal plate 34, a rearward wall 76 spaced inwardly of rear wall 22 of the housing, sealingly connected to plate 32 and the rear marginal edges of side walls 72 and 74 and a top wall 78 sealingly connected to side walls 72 and 74 and rear wall 76. A portion of the front wall 22 of the housing defines the front wall of the housing in which an opening 80 is formed. A door means 82 is provided for opening and sealingly closing opening 80. Door means 82 is pivoted to front wall 22 of the housing by hinges 84 for pivotal movement about a horizontal axis. Door 82 may also be provided with a heat resistant pane of glass 86.

Conduits 88 and 90 communicate the interior of oven section 36 with the exterior of the housing. Flow control means 92 disposed within conduits 88 and 90 are provided for controlling the flow of air through conduits 88 and 90. Conduits 88 and 90 and flow control means 92 serve as means for controlling the temperature within oven section 36. As with door means 42 of the combustion 28, door means 82 of the oven section are provided with adjustable air admitting means 96 (FIG. 1) of conventional construction.

Heat transfer section or chamber 34 is formed with a combustion product outlet opening 98 in rear wall 20 of the housing for connection to or reception of an exterior flue pipe 100. Disposed in the heat transfer chamber 34 is an interior flue pipe means 102 for connecting combustion product intake openings 60 and outlet opening 98.

Interior flue pipe means 102 is formed with a first portion of pipe 104 disposed within the space between side walls 16 and 18 of the housing and side walls 72 and 74 of the oven section, respectively. Each first portion 104 extends upwardly and forwardly of the housing having one end 102 sealingly connected to flue opening 60, and the other end connected to the forward end of an associated second portion 106 of the interior flue pipe means by a 180° elbow 108. The second portion is disposed in the space between the top wall 24 of the housing and top wall 78 of the oven section 36. Both second portions 106 extend from the forward end of the oven section 36 to the rearward end thereof and interconnected thereat by a T-section 110 having an outlet 112 for connection to the exterior flue pipe 100.

Thus, it will be understood that the flow of combustion products through the interior flue pipe means serves to heat the interior of heat transfer chamber which, in turn, serves to heat oven section 36. A conduit 114 is connected to the flue pipe 100 as best shown in FIGS. 2 and 3 for feeding ambient air into the flue pipe. Means (not shown) is provided for selectively controlling the flow of air through conduit 114.

Insulating material 116 is disposed on the interior surfaces of side walls 16 and 18, rear wall 20 and top wall 24 of the housing within heat transfer chamber f34 so as to minimize heat loss to ambient air in this vicinity.

Conduits 88 and 90 exit to the atmosphere or to appropriate radiators provided in the room or elsewhere in the house in which the wood stove is disposed.

As best shown in FIGS. 1 and 2, top wall 24 of the housing is formed with an upper horizontal wall 120 which defines the space between the top wall of the housing and oven in which the interior flue pipe means is disposed and a lower wall 122 which abuts the upper wall 78. An inclined wall portion 124 joins the top wall 120 and bottom wall 122. Top wall 122 may be used for heating a kettle or frying pan or the like.

Interior flue pipe means 116 is constructed of conventional heating pipes and components such as 22½°, 45°, 90° and 180° elbows and T-sections so that the interior flue pipe means can readily be removed from the stove and dismantled for cleaning or replacement purposes.

It will be understood that various modifications and alterations may be made to the above described wood stove without departing from the spirit of the invention as defined in the appended claims.

The embodiments of the invention in which an exclusive property or privilege is claimed are defined as follows:

1. A wood burning stove, comprising:

a housing having a combustion chamber, a heat transfer chamber and an oven disposed in said heat transfer chamber, said oven being sealed from said heat transfer chamber and said combustion chamber and having a pair of spaced side walls and a top wall sealingly connected to said side walls, said side walls being spaced from housing side walls and said top wall being spaced from a housing top wall;

a combustion product intake opening means communicating said combustion chamber and said heat transfer chamber, said opening means comprising an opening disposed in the space between each said oven side wall and said housing side wall;

a combustion product outlet opening in said heat transfer chamber adapted to be associated with a flue pipe disposed exteriorly of said housing;

and interior flue pipe means disposed in said heat transfer chamber adjacent said oven and interconnecting said combustion product intake opening means and said outlet opening;

said interior flue pipe means having a first portion disposed in each said space between each said oven side wall and housing side wall extending forwardly and upwardly therein, one end of each said first portion being sealingly connected to one of said combustion product intake openings, a second portion associated with each first portion and disposed between said oven top wall and said housing top wall and extending rearwardly of said heat transfer chamber, each said second portion having a forward end connected to the other end of an associated first portion and a rearward end, the rearwards ends of said second portions being connected together, and a third portion connecting the rearward ends of said second portions to said combustion product outlet opening.

2. A wood burning stove as defined in claim 1, further including insulation means on the inner surfaces of the outer walls of said heat transfer chamber.

3. A wood burning stove as defined in claim 2, further including conduit means sealingly connecting the interior of said oven to the exterior of said housing and valve means in said conduit means for selectively controlling the rate of air flow through said conduit means.

4. A wood burning stove as defined in claim 3, further including a cold air intake conduit opening into said interior flue pipe means adjacent said combustion product outlet opening.

5. A wood burning stove as defined in claim 4, further including an oven adjustable air intake means.

6. A wood burning stove as defined in claim 5, said combustion chamber having an interior combustion product deflection plate disposed adjacent said combustion product intake openings for directing products of combustion into said intake opening means.

7. A wood burning stove as defined in claim 6, further including removable plate means mounted adjacent the upper wall of said combustion chamber for preventing direct contact of a flame within said combustion chamber with said upper wall of said combustion chamber.

8. A wood burning stove as defined in claim 7, said housing having a movable top for providing access to said heat transfer chamber.

9. A wood burning stove as defined in claim 8, said movable top being pivotally mounted to said housing adjacent the back end of said housing.

* * * * *